US005267462A

United States Patent [19]

Pijanowski

[11] Patent Number: 5,267,462

[45] Date of Patent: Dec. 7, 1993

[54] PORTABLE RESCUE DEVICE

[76] Inventor: Joseph A. Pijanowski, 14351 Irving St., Brooksville, Fla. 34609

[21] Appl. No.: 955,427

[22] Filed: Oct. 2, 1992

[51] Int. Cl.[5] ..... B21D 1/12

[52] U.S. Cl. ..... 72/392

[58] Field of Search ..... 72/392, 705

[56] References Cited

U.S. PATENT DOCUMENTS

| | | | |
|---|---|---|---|
| 2,750,983 | 6/1956 | Rogers | 72/392 |
| 3,577,881 | 5/1971 | Markovics . | |
| 3,891,187 | 6/1975 | Bearden . | |
| 4,088,006 | 5/1978 | Patten . | |
| 4,273,311 | 6/1981 | Rio . | |

*Primary Examiner*—Lowell A. Larson

*Attorney, Agent, or Firm*—David Kiewit

[57] ABSTRACT

A portable jack-frame apparatus allows rescue personnel to rapidly force open a partially crushed automobile body and to passively hold open the aperture that they make so that they can remove a trapped accident victim from the vehicle. The invention provides a locking jack frame that can be: 1) inserted into a restricted opening in a car body, using a combination of pin-set telescoping extensions and a slidable lock to attain a best initial fit position; 2) used with a hydraulic actuator to forcibly make an opening large enough for rescue access; 3) employed to passively hold the opening in the enlarged position after the actuator is removed; and 4) be released and removed from the enlarged opening without further use of the hydraulic actuator.

13 Claims, 3 Drawing Sheets

PORTABLE RESCUE DEVICE

BACKGROUND OF THE INVENTION

The present invention provides portable apparatus that allows rescue personnel to rapidly force open a partially crushed automobile body and to passively hold open the aperture that they thereby make so that they can easily remove a trapped accident victim from the vehicle.

The prior art offers a variety of tools and methods to forcibly make a rescue opening in a crushed automobile body. These approaches generally leave the tools (e.g. a hydraulic ram) in a position that obstructs the aperture that it forms. Moreover, prior art equipment generally does not provide effective means of holding the rescue aperture open, except by maintaining hydraulic pressure in the actuator.

Other prior art rescue techniques involve using saws, torches, or hydraulically-powered shears for cutting away major portions of a damaged vehicle body so that rescuers can gain access to a trapped victim. These methods all carry a risk of further injury to the trapped victim if the vehicle body collapse further when key structural elements are cut away.

Prior patent art in this area is represented by:

U.S. Pat. No. 3,577,881, wherein Markovics teaches the use of a hydraulic actuator with suitable extension and vehicle-body clamping members. Markovics combines this with a jack frame that is pin-lockable and that has a telescoping frame for setting up a best initial fit. Markovics' jack frame is installed external to the vehicle and does not incorporate a lock that would hold it in position so that the actuating cylinder could be removed.

U.S. Pat. No. 3,891,187, wherein Bearden teaches a hydraulic actuator that is adapted to either "push" (i.e. act as an internal expanding hydraulic actuator) and "pull" (i.e. act externally on an automobile body by using the combination of a chain and a clevis hook at the end of an expandable hydraulic actuator) to form a rescue aperture.

U.S. Pat. No. 4,273,311, wherein Rio teaches a hydraulic spreader comprising two jaws that can be inserted into a small opening and then moved away from each other by a hydraulic mechanism so as to form a rescue opening. One version of Rio's device has jaws that can be pivoted out of the way once an opening has been made so as to offer the rescuers improved access to the victim. Rio requires continued hydraulic pressure to keep his jaws in an open position—i.e. he does not have a mechanical lock that protects against a leak in the hydraulic system.

Improvements to Rio's tool, which is of the sort generically known in the field as the 'jaws of life', have been offered by Wilson et al in U.S. Pat. No. 4,522,054 and by Ganley in U.S. Pat. No. 4,896,862.

Patten, in U.S. Pat. No. 4,088,006, teaches a hydraulic jack frame with a manually settable mechanical lock for use in an automotive body and frame straightening shop. The composite apparatus taught by Patten involves not only a jack frame, but also a track that is anchored to the shop floor. The lock on Patten's jack frame requires hydraulic pressure for its release, and maintains tension in a portion of a chain external to the jack frame. Neither Patten's locking mechanism nor his requirement of a frame anchored to a floor is compatible with use for rescue purposes.

SUMMARY OF THE INVENTION

It is a specific object of the invention to provide a locking jack frame that can be: 1) inserted into a restricted opening in a car body, using a combination of pin-set telescoping extensions and a slidable lock to attain a best initial fit position; 2) used with a hydraulic actuator to forcibly make the opening large enough for rescue access; 3) employed to passively hold the opening in the enlarged position; and 4) be released and removed from the enlarged opening without further use of the hydraulic actuator.

It is a further object of the invention to provide apparatus that holds a rescue opening, forcibly formed in a vehicle body, fully open without having a major portion of the apparatus extending across the opening and thereby restricting access to the interior of the damaged vehicle.

It is yet a further object of the invention to reduce the risk of further injury to an auto accident victim by forming a rescue aperture in a damaged car body without having to cut into the body so that major pieces can be moved out of the way. Cutting through structural pieces can cause further collapse of the car body onto the victim.

It is an additional object of the invention to provide a portable jack frame apparatus that can be easily transported on a rescue vehicle and that can be carried from the rescue vehicle to a damaged vehicle by a single member of the rescue team.

DETAILED DESCRIPTION OF THE PREFERRED EMBODIMENT

Figure 1:
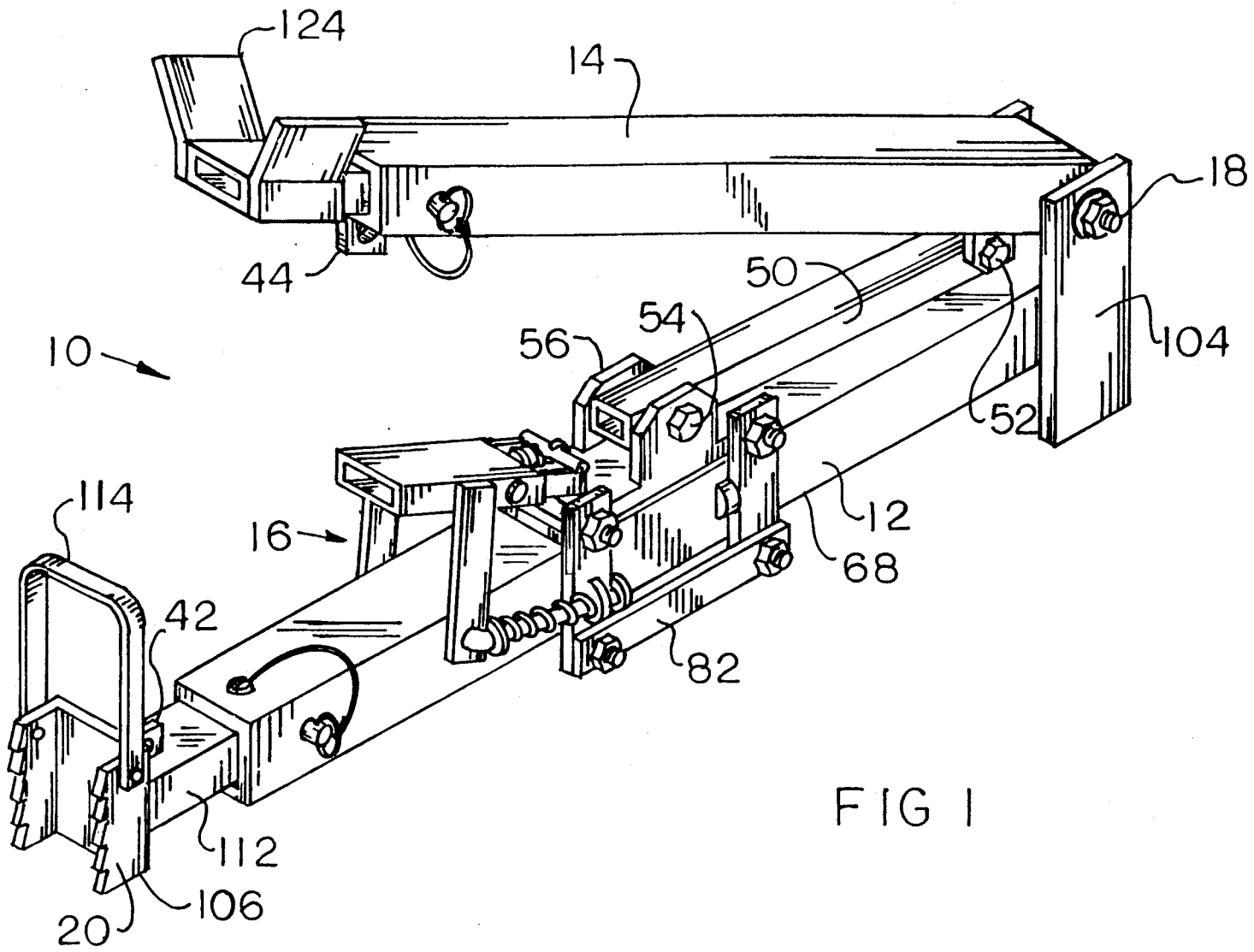
FIG. 1 of the drawing is an elevational view of a hydraulically-actuable jack frame of the invention in a folded position that is suitable for storage and transport of the apparatus.

Turning initially to FIG. 1 of the drawing, one finds an automatically lockable jack frame 10 that can be used to expand a pre-existing opening in a vehicle body so as to form a rescue aperture. The major elements of the frame 10 are a first, base leg 12, a second, actuable leg 14 and an automatic locking mechanism 16 that is used to hold the jack frame 10 in an opened position, as will be subsequently discussed. The two legs 12, 14 are hinged together at one end (e.g. with hinge pin 18) so that the distal ends 20, 22 of the legs 12, 14 can rotate toward or away from each other. In the view of FIG. 1, the two legs 12, 14 are shown in an intermediate position, in which the frame might fit into an opening in a partially crushed automobile body that is to be pried open. When the actuable leg 14 is rotated so that its distal end 22 is as close to the base leg 12 as is possible, the jack frame 10 is in a collapsed position useful for transport or storage of the apparatus.

Figure 2:
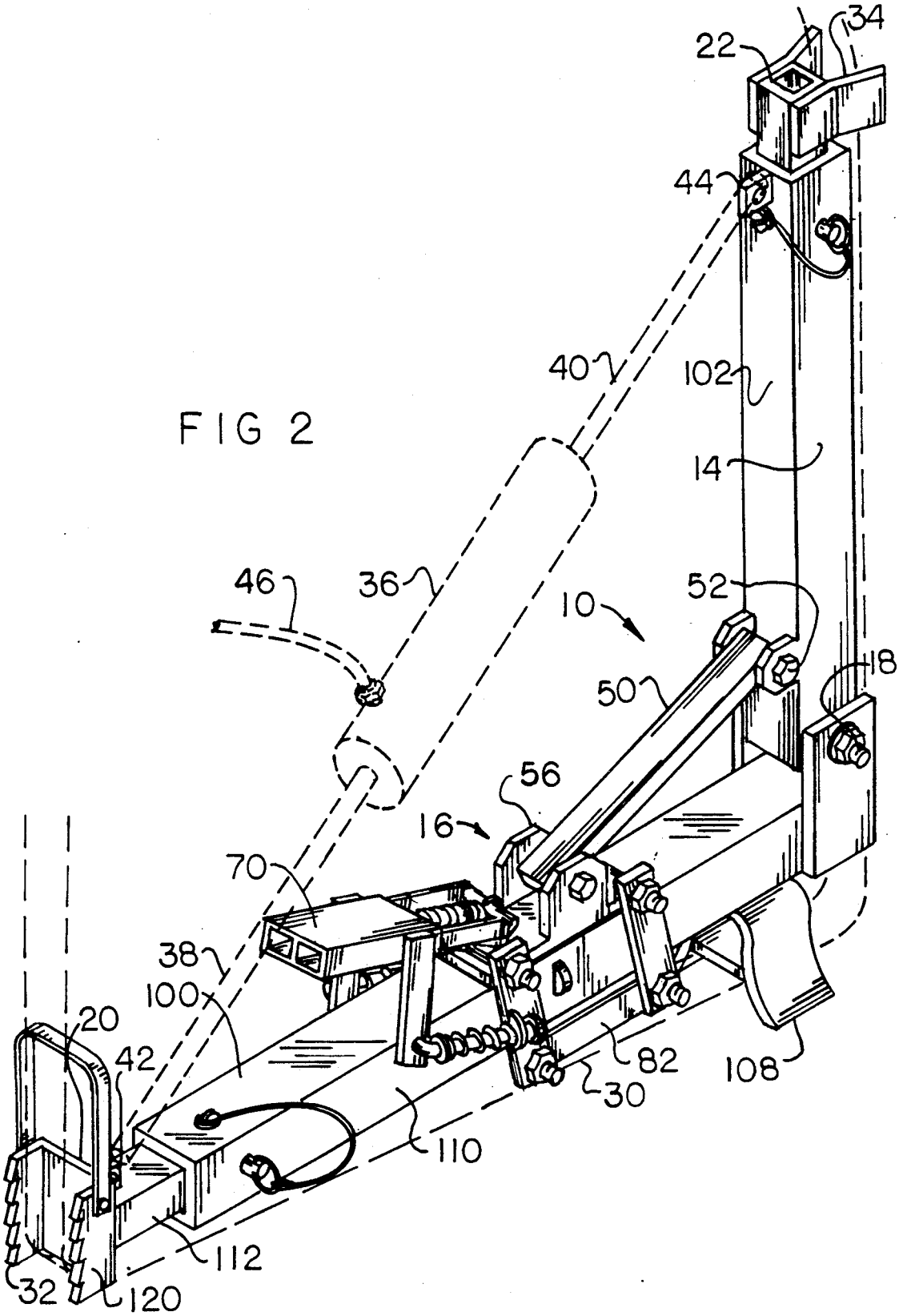
FIG. 2 of the drawing is an elevational view of a jack frame of the invention installed, with a hydraulic actuator, in a partially crushed automobile door frame opening.

Turning now to FIG. 2 of the drawing, one finds the jack frame 10 in an extended position, typical of its use to aid in widening an opening initially offered by a crushed automobile door frame opening 30 (shown in phantom). In the view of FIG. 2, suitable clamping means 32, 34 at the distal ends 20, 22 of the two legs 12, 14, are used to engage various portions of the door frame opening 30. An extensible fluid actuator 36 (shown in phantom in FIG. 2) has two extension legs 38, 40 that are held between attachment points 42, 44 provided on the two legs 12, 14. When the actuator 36 acts to move the extension legs 38, 40 relatively outward, it forces the clamping means or end adaptors 32, 34 against the door frame opening 30 and thereby acts to enlarge it.

Figure 4:
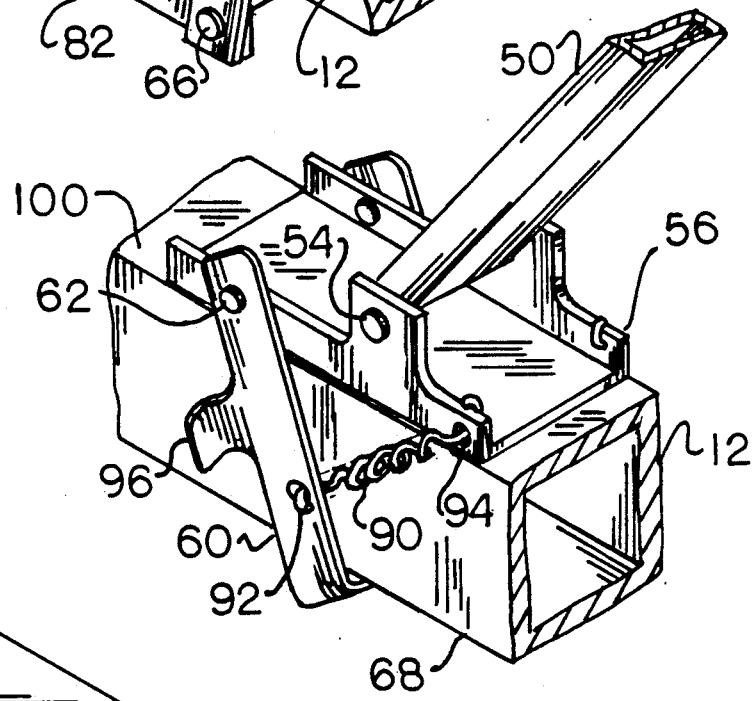
FIG. 4 of the drawing is a detailed elevational view of a second slidable locking mechanism, shown in its locked position.
Figure 5:
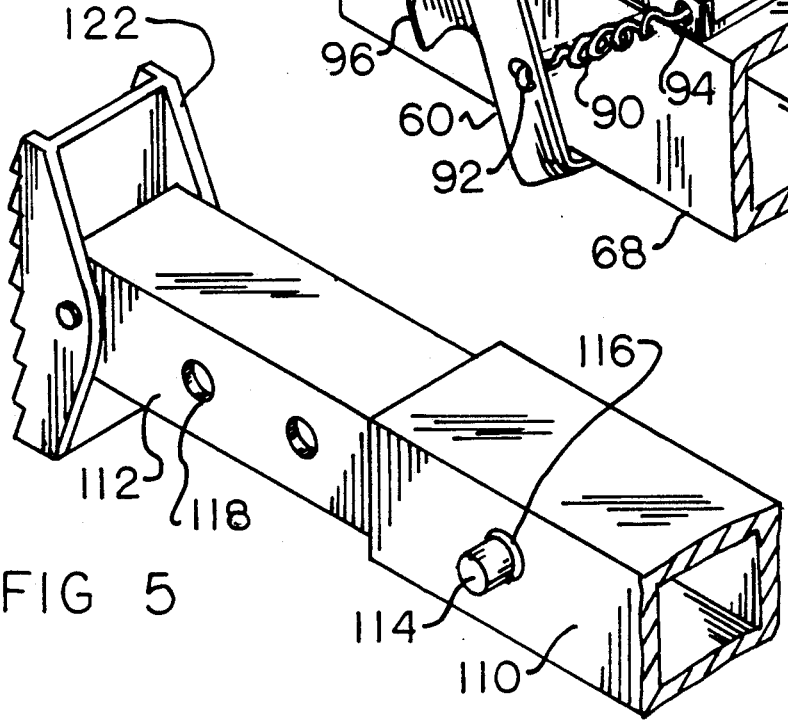
FIG. 5 of the drawing is a detailed view of a telescoping leg of the jack frame that can be pin-fastened to a best initial fit position.

The actuator 36 may be any sort of linear force applying apparatus that can force the distal ends 20, 22 of the jack frame 10 relatively apart. Preferably, the actuator 36 is a hydraulic cylinder that is powered by a pump (not shown) connected to the cylinder by a suitable flexible hydraulic hose 46. Linear motors of this sort are conventionally used in automotive rescue (e.g. as is shown in FIGS. 4 and 5 of U.S. Pat. No. 3,577,881) and are commonly called "porta-power" units.

It is well known in the rescue art to use a hydraulic cylinder to enlarge a pre-existing opening in a vehicle body so that a crash victim can be rescued. Established practice also provides the cylinder with demountable extension legs that allow the operator to adapt the apparatus to the initial size of the hole. A significant problem with prior art practice is that the actuator extends diametrically across the enlarged hole and constitutes a serious obstruction to rescue workers. Removing the prior art apparatus to offer the largest possible rescue aperture carries the risk that portions of the vehicle body that were previously forced apart may collapse back together and further injure the trapped person awaiting rescue.

The lockable jack frame 10 of the invention provides an improved method of stretching out an opening in a car or truck body by allowing the removal of the linear actuator 36. A key element of the jack frame 10 is the latching mechanism 16 that is used to hold the jack frame 10 in position around the periphery of the rescue aperture after the linear motor 36 has been removed. As may be seen from FIG. 2 of the drawing, after the linear motor 36 is removed from the frame, the rescue aperture is relatively less obscured. Although the legs 12, 14 intrude into the expanded opening, and a compression arm 50 of the locking mechanism 16 extends across a portion of that opening, the opening is far less obstructed than it would be had the actuator 36 not been removed.

A preferred version of the locking mechanism 16 operates with a compression arm 50 connected to the actuable arm 14 of the frame 10 by a hinge 52. The mechanism 16, shown in FIGS. 1 and 2 of the drawing, and in greater detail in FIGS. 3 and 4 of the drawing, provides a hinged connection 54 to a lock body 56 that can slide along the base leg 12. A clevis 60 surrounds the base leg 12 and is connected to the lock body 56 by a hinge 62. The clevis 60 may be formed from a single sheet of material (e.g. as shown in FIG. 4), or may be a compound structure composed of straps 64 that extend from the lock body 56 to bolts or rods 66 that extend across the outer face 68 of the base leg 12 (i.e. the side opposite the side on which the lock body 56 is disposed).

The preferred sliding clevis latch is generally in one of two positions. In a first, latched, position (shown in FIGS. 2 and 4), the clevis 60 slides along the base arm 12 toward the main hinge 18 as the distal ends 20, 22 of the jack frame 10 are moved apart by the actuator 36. In this latched position, the clevis 60 bears against the outer face 68 of the base leg 12 so that frictional forces between clevis 60 and the base leg 12 act to prohibit the jack frame 10 from closing. In a second, released position (shown in FIGS. 1 and 3 of the drawing), the position of the clevis 60 is changed so as to permit closing of the jack frame 10 and to prohibit opening.

Figure 3:
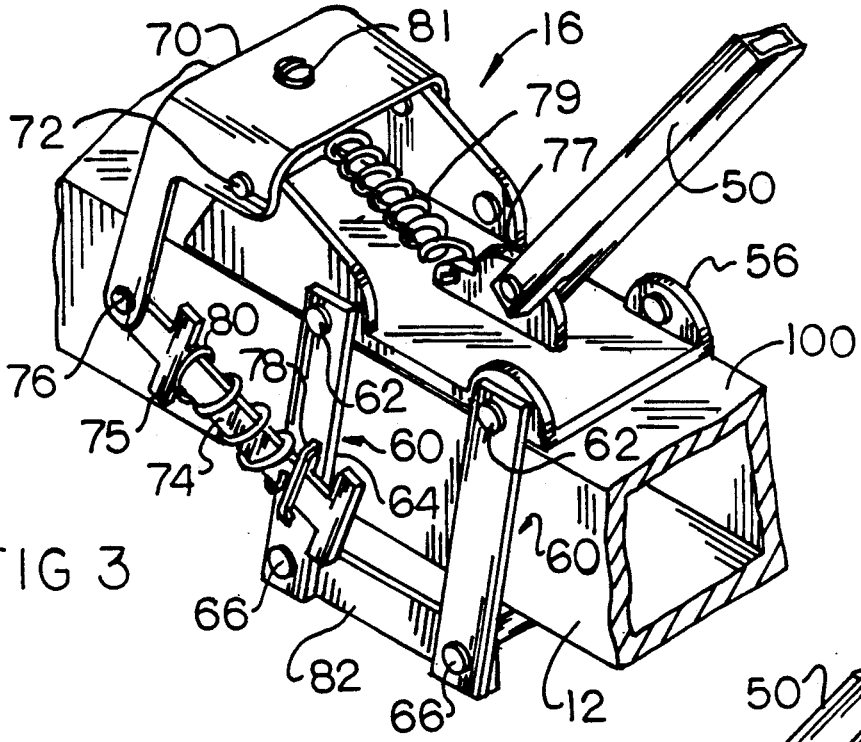
FIG. 3 of the drawing is a detailed elevational view of a slidable locking mechanism, shown in its released position.

In a preferred version of the latch, shown in FIGS. 1, 2 and 3 of the drawing, a release handle 70 is hingeably connected to the lock body 56 e.g. by suitable rivets or bolts 72, and to a slider 74 by a second hinge 76. The other end of the slider 74 is fastened to a clevis strap 64 at an eyelet 78. A compression bias spring 80 is installed around the slider 74 between the clevis strap 64 and a slider crossarm 75, and acts to push the clevis 60 away from the release handle 70. When the release handle 70 is rotated into its latched position (e.g. as shown in FIG. 2), the clevis 60 is biased by the spring 80 into a latched position, as described above. When the release handle 70 is lifted away from the base leg 12 (e.g. FIG. 3), the clevis 60 is rotated into the unlatched position.

In the preferred embodiment of the release mechanism a tension spring 79 is used to ensure that the release handle is biased into either a fully latched or a fully released position. The snap-over tension spring 79 is connected between a fixed attachment point 77 on the slider body 56 and an anchor 81 on the release handle 70. When the release handle 70 is lifted upward (e.g. FIG. 3) so that the approximate midpoint of the snap-over spring 79 rises above the level of the hinge bolts 72, contraction of the spring 79 acts to bias the release handle 70 into a fully released position. Conversely, when the release handle 70 is pushed downward so that the spring 79 goes below the level of an imaginary line drawn between the hinge rivets 72 on opposite sides of the slider body 56, contraction of the snap-over spring 79 biases the release handle 70 into a fully latched position (e.g. FIGS. 1 and 2) in which the end of release handle 70 that is distal from a hinge point 72 is adjacent the top surface 100 of the base leg 12 of the jack frame 10.

It will be recognized that although there are multiple ways of forming the release handle hinge 72, the acceptable ways do not include a hinge pin extending across the slider body 56. Such a hinge pin would block the motion of a snap-over spring 79. Other hinge points 62 on the latching mechanism do not operate with this constraint and may be provided with (not shown) or without a hinge pin extending across the slider body in the interest of providing greater strength.

A multiple-clevis latch, such as that shown in FIGS. 1–3, provides greater frictional forces and thereby provides a more useful jack frame 10. In such a multi-clevis latch, the clevises 60 are joined by a secondary latch arm 82, which serves to move the clevises 60 in unison between the latched and the unlatched states.

An alternative version of the clevis latch is shown in FIG. 4 of the drawing. Here, a single piece clevis 60 is biased into a latched position by a tension spring 90 connected between a first attachment point 92 on the clevis 60 and a second attachment point 94 on the sliding lock body 56. A release tab 96 that may be formed integrally with the clevis body 60 serves to unlatch the jack frame 10.

It will be understood by those skilled in the art that many other known approaches may be taken to realize the frame locking feature of the invention. One could, for example, provide teeth (not shown) on the inner faces 100, 102 of the legs 12, 14, and provide a separate compression arm (e.g. with a screwdriver-like blade formed on each end thereof) that could be fit into the teeth so as to hold the jack frame 10 open. Since a detachable compression arm could be misplaced in the controlled frenzy of a rescue operation, this design is deemed by the inventor to be of substantially lesser value than the preferred embodiment.

As yet another alternative, one could put a ratchet mechanism on the end of a compression arm 50 that was hinged to the actuable arm 14 of a jack frame 10. The ratchet would engage teeth formed on the inner face 100 of the base leg 12 (i.e. a mechanism similar to that widely used on portable automotive bumper jacks).

It may be noted that the preferred sliding clevis latching mechanism of the invention requires that outer face 68 of the base leg 12 be held away from portions of the automobile body so that the clevis 60 does not become jammed e.g. between the base leg 12 and the door frame opening 30. In the version of the jack frame 10 that is illustrated in FIG. 1 of the drawing, this spacing is ensured by providing that a portion of the hinge block 104 and the channel adapter 106 extend far enough beyond the outer face 68 of the base leg 12. In the version of the jack frame 10 that is shown in FIG. 2 of the drawing, a separate spacer 108 is provided to serve the same function. It will be recognized that a wide variety of geometrical structures can be employed to serve the same end.

The base leg 12 may be a single member, but is preferably a compound extensible structure that allows the jack frame 10 to be fit into a wide variety of pre-existing openings. As shown in FIG. 1, and in greater detail in FIG. 5 of the drawing, this feature is preferably provided by the use of a compound base leg 12 comprised of a fixed outer member 110 and a telescoping inner member 112. A pin 114, as is well known, can be inserted through aligned ones of arrays of holes 116, 118 formed in the outer and inner members to adjust the length of the compound leg. Alternate design approaches to forming an extensible leg or legs for the jack frame, e.g. using an internally threaded collar at the end of the outer member 110 and a mating externally threaded inner member 112, are well known in the art. All such methods serve the purpose of allowing the operator a convenient method of adapting the jack frame 10 to a best-initial-fit position within the pre-existing hole in a vehicle body that needs to be enlarged for a rescue operation.

A variety of adapters are known for use at the ends of legs 12, 14 of the jack frame 10. FIG. 1 of the drawing, for example, shows a channel adapter 106 (which, as a matter of convenience, has an attached carrying handle 114) that can fit around the "B" pillar at the rear end of an automobile front door frame opening 30. Alternately, a fixed toothed adapter 120, as shown in FIG. 2 of the drawing, or a swivel-footed toothed adapter 122, as shown in FIG. 4 of the drawing may also be employed for this purpose. In addition to the foregoing, one can also use a wye-jawed adapter 124, as shown in FIGS. 1 and 2 of the drawing. The wye-jawed adapter 124 is generally preferred for bearing on the "A" pillar at the front of a front door opening 30 in a vehicle body, as shown in FIG. 2.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is desired to be secured by Letters Patent is:

1. Rescue apparatus for deformably enlarging a pre-existing opening in a vehicle body, said apparatus comprising an expandable frame comprising two legs having two ends, said legs hingeably connected at their first ends, whereby said legs can be rotated toward each other into a relatively closed initial position in which said second ends of said legs are adapted to be inserted into said existing opening and a locking means and a demountable fluid powered actuator means adapted to fit between said legs at attachment points adjacent said second ends when said frame is in said initial position, to act to rotate said legs into a relatively open position, thereby deformably enlarging said pre-existing opening into an enlarged state and to be demounted from said frame in said relatively open position, whereby said locking means acts to lock said frame into said relatively open position thereby holding said opening in said enlarged state.

2. Apparatus of claim 1 wherein a said leg is extensible to adapt said leg for optimal insertion in said pre-existing opening.

3. Apparatus of claim 2 wherein said extensible leg comprises a telescoping leg adapted to be pin-fastened to one of a plurality of predetermined initial lengths.

4. Apparatus of claim 1 wherein said locking means comprises a plate, a release mechanism having a locked and an unlocked position, a bias spring and a locking clevis, said clevis hingeably attached to said plate and surrounding a first said leg, and a locking arm having a first end and a second end, said first end of said arm hingeably connected to said plate and said second end of said arm hingeably connected to said second leg, wherein said bias spring acts to hold said clevis in a first position when said release mechanism is in said locked position and said clevis, when in said first position, acts to allow said second ends of said legs to rotate away from each other but to prohibit said second ends of said legs to rotate toward each other, and said bias spring acts to hold said clevis in a second position when said release mechanism is in said unlocked position and said clevis, when in said second position, acts to allow said second ends of said legs to rotate toward each other but to prohibit said second ends of said legs to rotate away from each other.

5. Apparatus of claim 4 further comprising a spacer attached to said first leg, said spacer adapted to hold said clevis out of contact with an edge of said opening.

6. Apparatus of claim 4 further comprising a handle means attached adjacent said second end of said first leg.

7. Apparatus of claim 1 wherein said fluid powered actuator means comprises an hydraulic cylinder having two co-linear pistons and a pump, external to said cylinder and connectable to said cylinder, said pump having a source of fluid, whereby said fluid, when pumped into said cylinder by said pump, acts to drive said pistons apart.

8. Apparatus of claim 7 further comprising an extension rod adapted for attachment between an end of a said piston and a said attachment point on a said leg.

9. A jack frame for use in holding open a rescue aperture deformably created in a vehicle body comprising a base leg having a first attachment point for a demountable actuator adjacent a first end thereof, said base leg connected by means of a first hinge at a second end of said base leg, to an actuable leg having a second attachment point for said demountable actuator at an end thereof distal from said first hinge, and having a third attachment point for a compression arm at a point intermediate between said hinged end and said distal end, and a locking means comprising a said compression arm having a first end hingeably connected to said actuable leg at said third attachment point and a second end hingeably connected to a lock body adapted to slide along said base leg and having a release lever hingeably attached to said body, said lever having a released state and a latched state, a clevis hingeably connected to said lock body and surrounding said base leg, and a bias spring interposed between said clevis and said release lever whereby said bias spring acts to bias said clevis into a first position when said lever is in said released state and said bias spring acts to bias said clevis into a second position in contact with said base leg when said lever is in said latched state, whereby said locking means serves to permit said first hinge to open so that said first end of said base leg and said distal end of said actuable leg move relatively away from each other and to prohibit said first hinge to close when said lever is in said latched position, and whereby said locking means serves to permit said first hinge to close and to prohibit said first hinge to open when said lever is in said released position.

10. A jack frame of claim 9 further comprising a spacer attached to said base leg, said spacer adapted to hold said clevis out of contact with an edge of said aperture.

11. A jack frame of claim 9 further comprising a handle attached adjacent said first end of said base leg.

12. A method of deformably enlarging a pre-existing hole in a vehicle body to create a rescue aperture, said method comprising the steps of:

a) inserting a hinged, lockable jack frame having two legs into an existing hole in said body;

b) mounting an extensible fluid-operated force exerting means between attachment points on each said leg, said attachment points being distal from said hinge;

c) operating said force exerting means to deformably enlarge said hole, thereby creating an enlarged aperture suitable for rescue purposes, save for the presence of said force exerting means extending diametrically across said enlarged aperture; and d) demounting said force exerting means from said frame, whereby said enlarged aperture is held open by said lockable jack frame and is suitable for rescue purposes.

13. A method of claim 12 further comprising the steps of e) manually releasing a latch and collapsing said lockable jack frame and f) removing said jack frame from said aperture.

* * * * *